US006994085B2

(12) United States Patent
Shiue

(10) Patent No.: US 6,994,085 B2
(45) Date of Patent: Feb. 7, 2006

(54) SPLASH GUARD FOR A SNORKEL

(75) Inventor: Chih-Cheng Shiue, Escondido, CA (US)

(73) Assignee: QDS Injection Molding LLC., Escondido, CA (US)

( * ) Notice: Subject to any disclaimer, the term of this patent is extended or adjusted under 35 U.S.C. 154(b) by 29 days.

(21) Appl. No.: 10/920,266

(22) Filed: Aug. 18, 2004

(65) Prior Publication Data

US 2005/0274380 A1 Dec. 15, 2005

(30) Foreign Application Priority Data

Jun. 15, 2004 (TW) ..... 093209423 U

(51) Int. Cl.
*B63C 11/16* (2006.01)
*B63C 11/02* (2006.01)

(52) U.S. Cl. ..... 128/201.11; 128/201.27; 405/186

(58) Field of Classification Search ..... 128/200.24, 128/200.29, 201.11, 201.26, 201.27, 201.28, 128/202.14, 206.26; 405/186, 185, 187
See application file for complete search history.

(56) References Cited

U.S. PATENT DOCUMENTS 2,815,751 A * 12/1957 Ferraro ..... 137/410
2,909,959 A * 10/1959 Girden ..... 2/427
3,166,083 A * 1/1965 Girden ..... 137/388
3,345,984 A * 10/1967 Katehis ..... 128/201.11
5,404,872 A * 4/1995 Choi ..... 128/201.11
5,960,791 A * 10/1999 Winefordner et al. . 128/201.11
6,276,362 B1 * 8/2001 Chen-Lieh ..... 128/201.11
6,679,253 B1 * 1/2004 Feng ..... 128/201.11

* cited by examiner

*Primary Examiner*—Teena Mitchell
(74) *Attorney, Agent, or Firm*—Troxell Law Office, PLLC

(57) ABSTRACT

A splash prevention device, mounted on top of the breathing tube of a snorkel, including a housing having an oblique opening in communication with the breathing tube, a U-shaped pivotal member pivotally mounted on the housing, a float member pivotally located on two ends of a cross member of the pivotal member and including a top stop, a pivotal cover pivotally located on the cross member and including a tab and a projection at both ends, and a mask partially enclosed the housing and mounted thereon. The float member and the pivotal member pivot about the housing and the pivotal cover pivots about the cross member when the splash prevention device is submerged below a water surface. The pivotal actions are stopped when the opening is closed by the projection of the pivot cover to prevent splashed water from entering the breathing tube of the snorkel.

7 Claims, 3 Drawing Sheets

SPLASH GUARD FOR A SNORKEL

FIELD OF THE INVENTION

The present invention relates to snorkels and more particularly to a device for effectively preventing splashed water from entering the breathing tube of a snorkel.

BACKGROUND OF THE INVENTION

Water from a wave or that is splashed may enter a top opening of a breathing tube of a snorkel when used for snorkeling or diving. To solve this problem, the top opening is typically bent and a louver-like member (i.e., splash prevention device) is provided on the mouth of the top opening. To be effective a splash prevention device should have the following features: (i) prevent splashed water from entering the breathing tube of a snorkel while permitting a free passage of air during use, (ii) be compact; (iii) should not obstruct a flow of air for breathing; and (iv) have a low manufacturing cost. Currently, snorkels with a splash prevention devices do not have all of these features. Therefore, improvements in splash prevention devices for snorkels are constantly being sought.

SUMMARY OF THE INVENTION

It is an object of the present invention to provide a splash prevention device for a snorkel with a breathing tube. The splash prevention device includes: a hollow housing with an internal channel and a top opening in fluid communication with the breathing tube and located on a top end of the breathing tube; a U-shaped pivotal member pivotally connected to the housing; a float member including a top stop and pivotally connected on two ends of a cross member of the pivotal member and; a pivotal cover including a tab at a first end and a projection at a second end and pivotally connected to an intermediate portion of the cross member; and a mask connected to and partially enclosing the housing. The float member and the pivotal member pivot about the housing and the pivotal cover pivots about the cross member to a closed position when the splash prevention device is submerged below a water surface. In the closed position, the opening in the housing is closed by the projection of the cover so as to prevent splashed water from entering the breathing tube when a swimmer is breathing in.

It is an object of the present invention to have a center of gravity of the pivotal cover in the projection.

Another object of the present invention is to have the top stop contact the tab to limit the pivotal movement of the pivot cover.

The above and other objects, features and advantages of the present invention will become apparent from the following detailed description taken with the accompanying drawings.

DETAILED DESCRIPTION OF THE PREFERRED EMBODIMENTS

Figure 1:
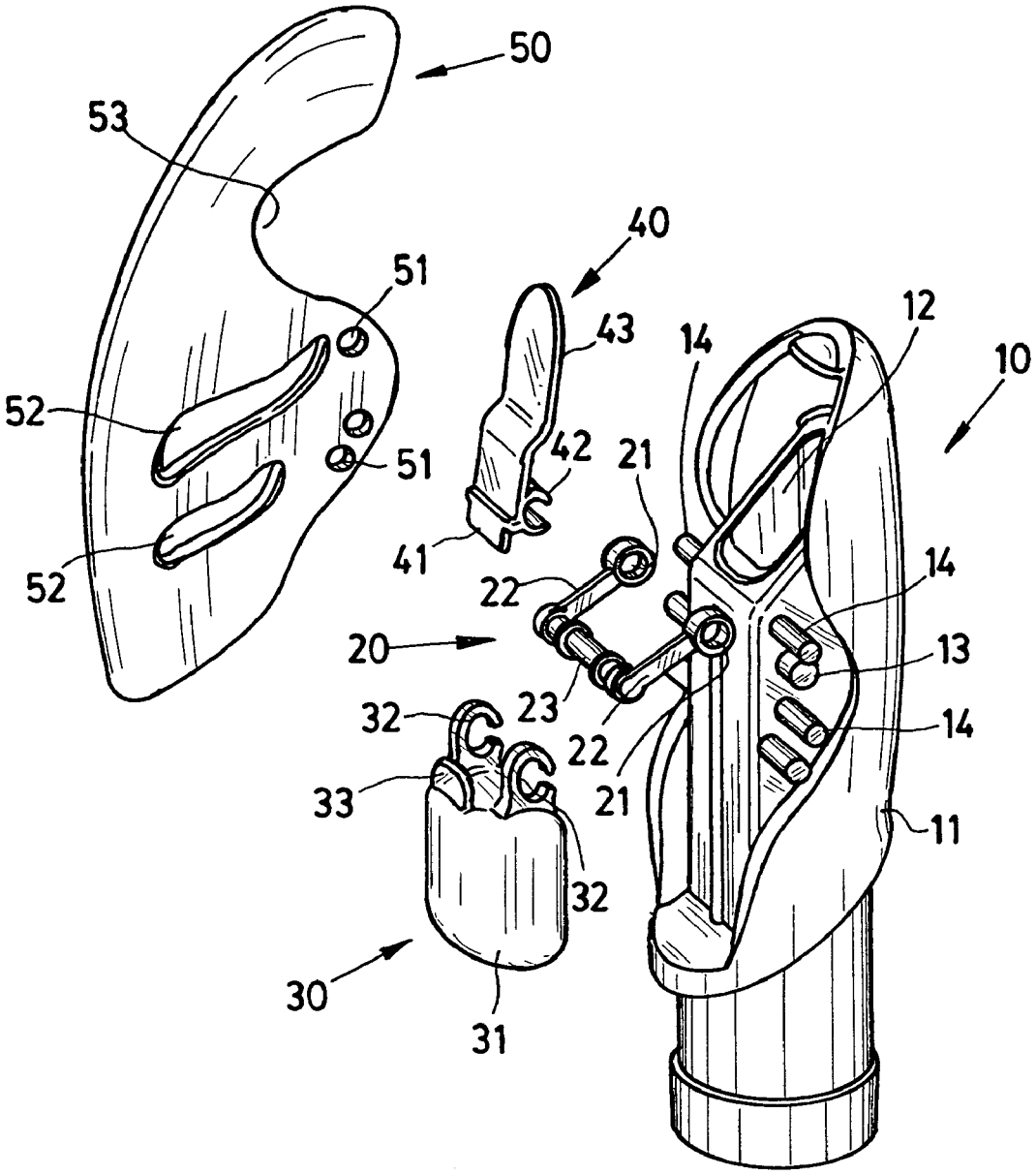
FIG. 1 is an exploded view of a first preferred embodiment of a splash prevention device according to the invention mounted on a top opening of the breathing tube of a snorkel.

FIGS. 1 to 5 illustrate a splash prevention device according to a first preferred embodiment of the present invention. The splash prevention device has a housing 10, a pivotal member 20, a float member 30, a pivotal cover 40, and a mask 50. Each component will be described in detailed below.

The elongated hollow tubular housing 10 is mounted on a top opening of a breathing tube of a snorkel (not shown) and has a main body 11 including a hollow internal channel (not shown) in fluid communication with the top opening of the breathing tube, an oblique opening 12 provided in an top end of the channel, a pivot pin 13 located on each of two opposing sides of the main body 11, and a plurality of pins 14 also located on the two opposing sides of the main body 11.

The U-shaped pivotal member 20 includes two short sleeves 21 pivotally connected to the pivot pins 13, two side bars 22, and a cross member 23 having a circular cross section.

The float member 30 has a specific gravity smaller than that of water. The float member 30 has a case 31, two top C-shaped hooks 32 pivotally connected to ends of the cross member 23, and a top stop 33 located between the hooks 32.

The pivotal cover 40 includes a tab 41, an elongated C-shaped member 42 pivotally connected to an intermediate portion of the cross member 23, and a projection 43.

The mask 50 has a curved edge 53 located on each of two sides, a plurality of holes 51 located on each of the two sides aligning with and connected to the pins 14, a plurality of elongated, curved openings 52, and a mask opening 54 formed between the mask 50 and the housing 10. The curved edges 53, the curved openings 52, and the mask opening 54 of the mask 50 communicate with the breathing tube of the snorkel through opening 12 on the housing 10 and an exterior of the snorkel to allow water and air to move therethrough.

Figure 2:
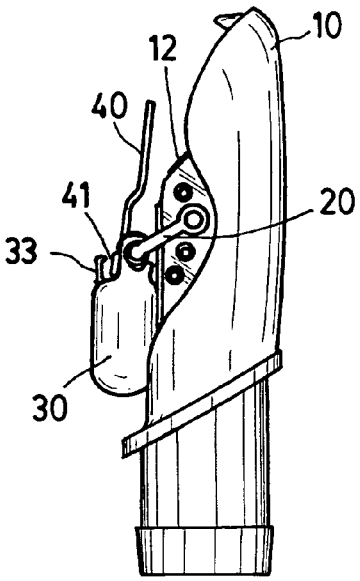
FIGS. 2, 3, and 4 are side views with the mask removed to illustrate a continuous operation of closing the opening by the float member and pivotal cover when the splash prevention device is submerged in water.
Figure 3:
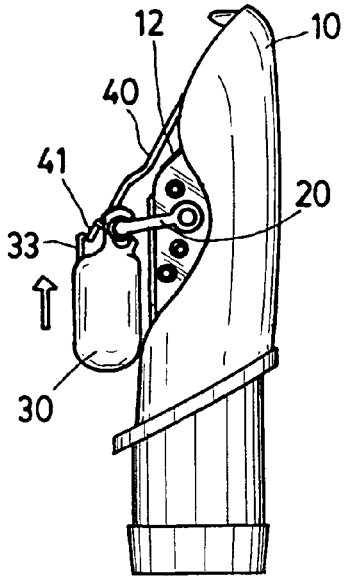
Figure 4:
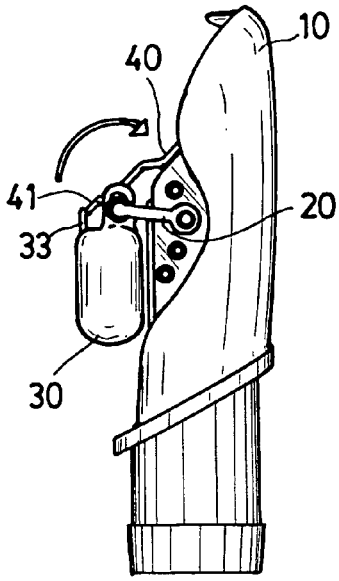
Figure 5:
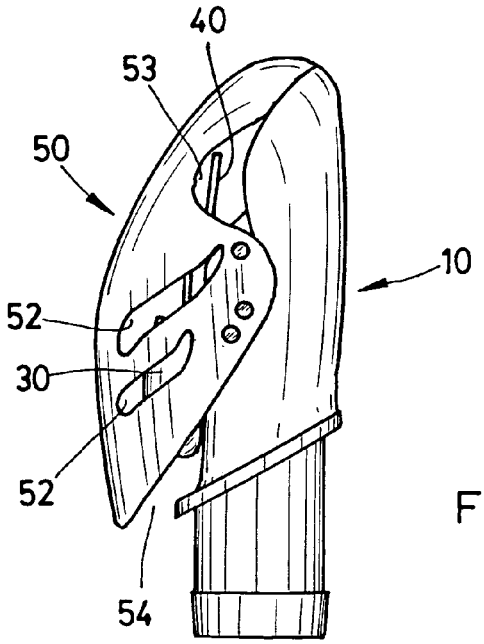
FIG. 5 is a perspective view of the assembled splash prevention device.

In use, the pivotal cover 40 and float member 30 are in open positions when a snorkel with the splash prevention device is located above a water level, such as when it is not in use or not in contact with water when a swimmer begins to swim (see FIG. 2). The pivotal member 20 begins to pivot clockwise about an axis passing through the first pivot pins 13 as the float member 30 is lowered in the water as the swimmer submerges his/her head below the surface of the water. At the same time as the float member is submerged into the water, the pivotal cover 40 pivots clockwise until the tab 41 contacts the top stop 33 (see FIG. 3) to prevent the pivotal cover 40 from closing the opening 12. Thus, the swimmer can breath in air when the opening 12 is in the open position as shown in FIGS. 2 and 3. The center of gravity of the pivotal cover 40 is in the right side of the pivotal cover 40 as shown in FIGS. 2–4. In a closed position, the projection 43 of the pivotal cover 40 is pivoted to cover the opening 12 of the housing 10 because the float member 30 rises with the water level, and the specific gravity of the pivotal cover 40 (see FIG. 4). In the closed position, the projection 43 of the pivotal cover 40 seals the opening 12 of the housing 10. Thus, splashed water and wave water are effectively prevented from entering the opening 12 (i.e., from entering the breathing tube of snorkel) when the swimmer is breathing in.

Figure 6:
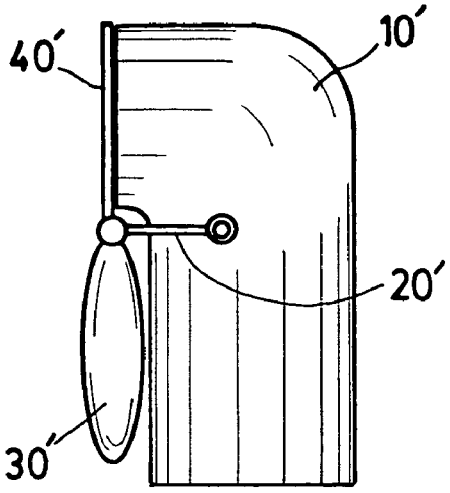
FIGS. 6 and 7 are side views of a second preferred embodiment of splash prevention device for snorkel according to the invention, wherein the mask is removed to illustrate a continuous operation of closing the opening by the float member and pivotal cover when the splash prevention device is submerged in water.
Figure 7:
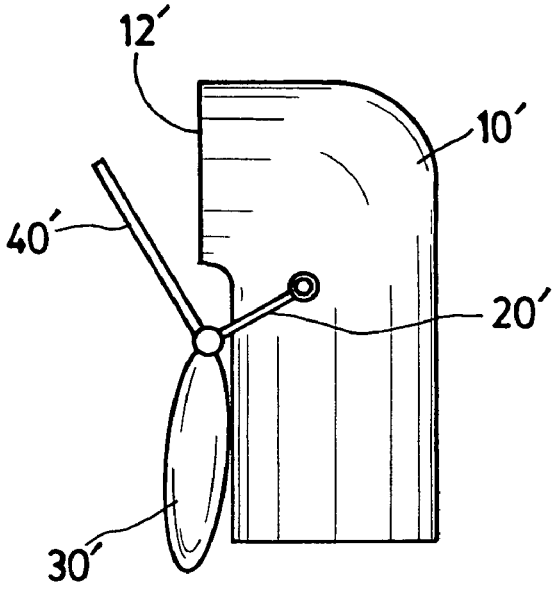

FIGS. 6 and 7 illustrate a second preferred embodiment of splash prevention device for snorkel according to the present invention. In the second preferred embodiment, the opening 12' is located vertically. The pivotal member 20' and the cover 40' are fixedly coupled together to form an angle of approximately 90 degrees therebetween. In this embodiment, the pivotal cover 40' is movable between open and closed positions, and closes and seals the opening 12 as water rises.

While the invention herein disclosed has been described by means of specific embodiments, numerous modifications and variations could be made thereto by those skilled in the art without departing from the scope and spirit of the invention set forth in the claims.

I claim:

1. A splash prevention device for a snorkel having a breathing tube, the splash prevention device comprising:

a) a hollow housing located on a top end of the breathing tube and having a top opening located in an interior of the hollow housing opposite the breathing tube and communicating with an interior of the breathing tube;

b) a U-shaped pivotal member pivotally connected to the housing and having a cross member;

c) a float member pivotally connected to the cross member of the pivotal member; and d) a pivotal cover connected to the U-shaped pivotal member and having a projection;

wherein the float member and the pivotal member pivot relative to the housing between open and closed positions, in the open position the projection of the pivot cover is spaced apart from the top opening of the housing and in the closed position the projection of the pivot cover covers and seals the top opening of the housing such that the projection prevents splashed water from entering the top opening, wherein the pivotal cover is pivotally connected to an intermediate portion of the cross member, wherein the pivotal cover includes a tab extending opposite to the projection, and the float member includes a top stop, whereby, the tab engages the top stop to limit pivotal movement.

2. A splash prevention device for a snorkel having a breathing tube, the splash prevention device comprising:

a) a hollow housing located on a top end of the breathing tube and having a top opening located in an interior of the hollow housing opposite the breathing tube and communicating with an interior of the breathing tube;

b) a U-shaped pivotal member pivotally connected to the housing and having a cross member;

c) a float member pivotally connected to the cross member of the pivotal member; and d) a pivotal cover connected to the U-shaped pivotal member and having a projection;

wherein the float member and the pivotal member pivot relative to the housing between open and closed positions, in the open position the projection of the pivot cover is spaced apart from the top opening of the housing and in the closed position the projection of the pivot cover covers and seals the top opening of the housing such that the projection prevents splashed water from entering the top opening further comprising a mask connected to and enclosing a predetermined portion of the hollow housing.

3. The splash prevention device of claim 2, wherein the mask includes a plurality of curved edges and a plurality of curved openings communicating with the interior of the hollow housing.

4. The splash prevention device of claim 2, further comprising a mask opening located between the mask and the hollow housing.

5. A splash prevention device for a snorkel having a breathing tube, the splash prevention device comprising:

a) a hollow housing located on a top end of the breathing tube and having a top opening located in an interior of the hollow housing opposite the breathing tube and communicating with an interior of the breathing tube;

b) a U-shaped pivotal member pivotally connected to the housing and having a cross member;

c) a float member pivotally connected to the cross member of the pivotal member; and d) a pivotal cover connected to the U-shaped pivotal member and having a projection;

wherein the float member and the pivotal member pivot relative to the housing between open and closed positions, in the open position the projection of the pivot cover is spaced apart from the top opening of the housing and in the closed position the projection of the pivot cover covers and seals the top opening of the housing such that the projection prevents splashed water from entering the top opening, wherein the pivotal cover is fixedly connected to the U-shaped pivotal member, further comprising a mask connected to and enclosing a predetermined portion of the housing.

6. The splash prevention device of claim 5, wherein the mask includes a plurality of curved edges and a plurality of curved openings communicating with the interior of the hollow housing.

7. The splash prevention device of claim 5, further comprising a mask opening located between the mask and the hollow housing.

* * * * *